US006220903B1

(12) United States Patent
Huang

(10) Patent No.: US 6,220,903 B1
(45) Date of Patent: Apr. 24, 2001

(54) PLASTIC HOUSING STRUCTURES FOR A BOARD-TO-BOARD CONNECTOR

(75) Inventor: Alex Huang, Taipei (TW)

(73) Assignee: CviLux Corporation, Taipei Hsien (TW)

( * ) Notice: Subject to any disclaimer, the term of this patent is extended or adjusted under 35 U.S.C. 154(b) by 0 days.

(21) Appl. No.: 09/459,594

(22) Filed: Dec. 13, 1999

(51) Int. Cl.[7] ..... H01R 9/22

(52) U.S. Cl. ..... 439/894; 439/892; 439/752; 29/739; 29/758

(58) Field of Search ..... 439/894, 892, 439/752, 752.5; 29/739, 747, 758

(56) References Cited

U.S. PATENT DOCUMENTS

| | | | | |
|---|---|---|---|---|
| 4,394,795 | * | 7/1983 | Goss | 29/739 |
| 4,396,245 | * | 8/1983 | Lane | 29/758 |
| 5,373,626 | * | 12/1994 | Youngfleish | 29/739 |
| 5,439,400 | * | 8/1995 | Kozel et al. | 439/885 |

* cited by examiner

*Primary Examiner*—Paula Bradley
*Assistant Examiner*—Tho D. Ta
(74) *Attorney, Agent, or Firm*—A & J

(57) ABSTRACT

The present invention relates to a plastic housing structure of a board-to-board connector comprising a base seat and a top cap, wherein the base having a central protruded rib portion with a plurality of slots along the two lateral sides of the rib portion, a through hole being formed at the bottom portion of the slot and the external side of the slot being corresponding to a plurality of notches having a sloping guiding surface at the inner surface thereof, at the two ends of the rib portion, an engaging surface being provided for engagement with a top cap, and the top surface of the engaging surface being provided with a blocking block and a protrusion; and the top cap is provided with an engaging portion at the side thereof, and the bottom portion is provided with a plurality of protruded blocks having a wavelike surface at the inner side thereof, thereby, the base seat and the top cap are combined, and the protruded blocks are inserted into the notches. The guiding pins are urged by the recess and the wavelike surface such that the guiding pins will not dislocate in the soldering process to remove the plastic housing, the top cap is lifted up and the guiding pins are released, but the guiding pins are retained on the circuit board.

4 Claims, 11 Drawing Sheets

PLASTIC HOUSING STRUCTURES FOR A BOARD-TO-BOARD CONNECTOR

BACKGROUND OF THE INVENTION (a) Field of the Invention

The present invention relates to the structure of a board-to-board connector, and in particular, to a plastic housing structure for a board-to-board connector.

(b) Description of the Prior Art

As shown in FIGS. 1 and 3, there is shown a conventional plastic housing 1 having a sliding recess 10 for the horizontal mounting of an angular board 11. The inner wall at the two sides of the sliding recess 10 is provided with a protruded lug 14, and the angular board 11 is provided with parallel rows of holes 12 for the mounting of the entire row of guiding pins 13. The protruded lug 14 of the sliding recess 10 provides appropriate clipping to the gliding pins 13. As shown in FIG. 3, the bottom surface of the plastic housing 1 of the connector is provided with three protruded boards 15 arranged in a row. There is a gap formed in between the individual protruded board 15 for the mounting of the guiding pins 13.

FIGS. 2 and 4 show the application of the above structure. The connector is mounted onto a circuit board, and the guiding pins 13 and the circuit board are soldered together by soldering process. Next, a cleaning process is applied and the plastic housing 1 is removed. In view of the first structure, in the process of removing the plastic housing 1, a force is exerted centrally onto the sides of the plastic housing 1 to cause the protruded lug 14 to release the urging force exerted onto the guiding pins 13, and the plastic housing 1 is then smoothly lifted up. In the second structure, the removal of the plastic housing 1 is by the use of robotic arm or it is manually lifted up.

In application, the above conventional structures have the following drawbacks.

1) In the first structure, the angular board has to be mounted horizontally and this is difficult to attain and time-consuming for the reason that the plastic housing and the angular board are very small in size.
2) In the first structure, if the plastic housing is to be lifted up from the circuit board to separate from the guiding pins, a force has to be exerted to the sliding recess. This force is difficult to keep balance and the guiding pins cannot be smoothly separated.
3) In the second structure, the guiding pins are clipped by the force between the boards, if the clipping force is too great, the guiding pins and the plastic housing may not be smoothly separated. If the clipping force is too small, the guiding pins may be dislocated during the soldering process.

SUMMARY OF THE PRESENT INVENTION

Accordingly, it is an object of the present invention is to provide a plastic housing for board-to-board connector, which allows rapid and easy separation of the plastic housing and the entire row of the guiding pins, such that all the guiding pins remain onto the circuit board when the plastic housing is lifted up.

Other objects, advantages, and novel features of the invention will become more apparent from the following detailed description when taken in conjunction with the accompanying drawings.

DETAILED DESCRIPTION OF THE PRESENT INVENTION

Figure 1:
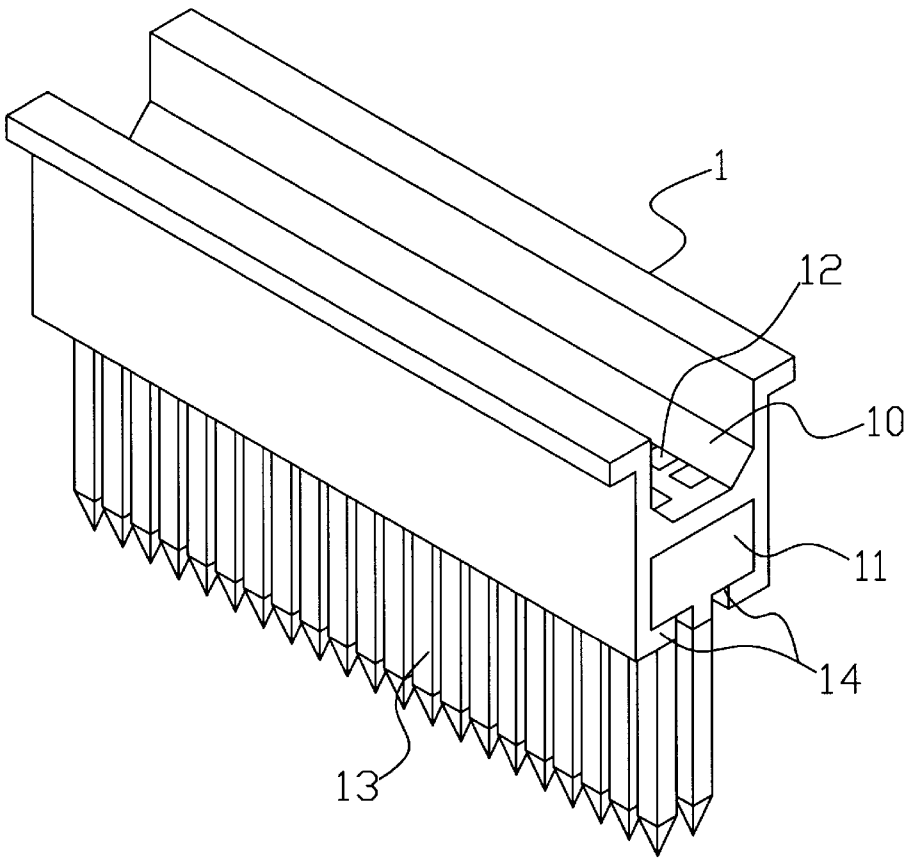
PRIOR ART FIG. 1
FIG. 1 is a perspective view of a conventional board-to-board connector.
Figure 2:
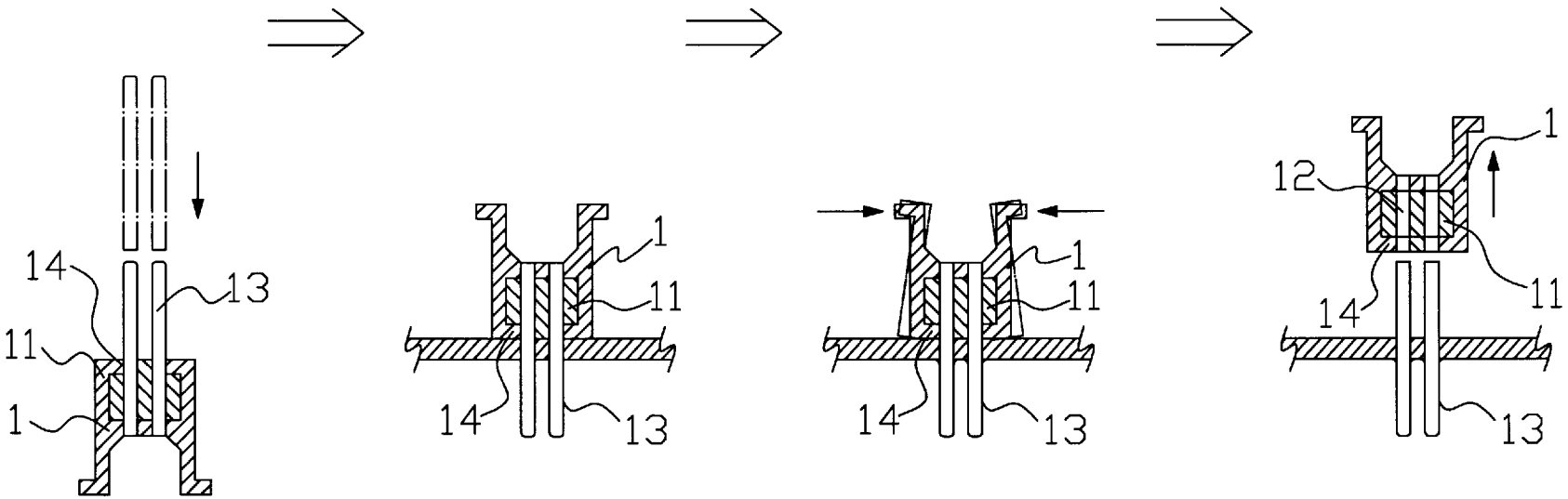
PRIOR ART FIG. 2
FIG. 2 illustrates schematic views showing the implementation of the conventional plate-to-plate connector of FIG. 1.
Figure 3:
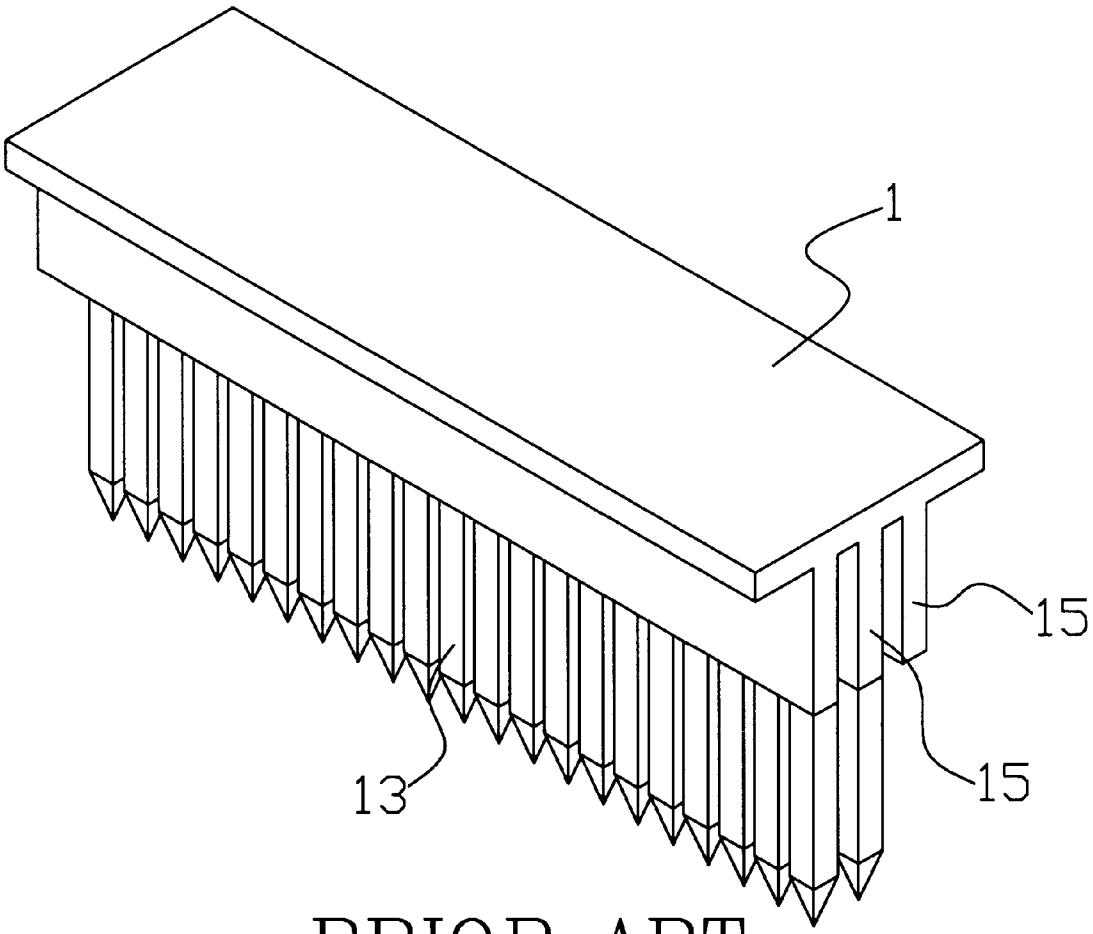
PRIOR ART FIG. 3
FIG. 3 is a perspective view of another conventional board-to-board connector.
Figure 4:
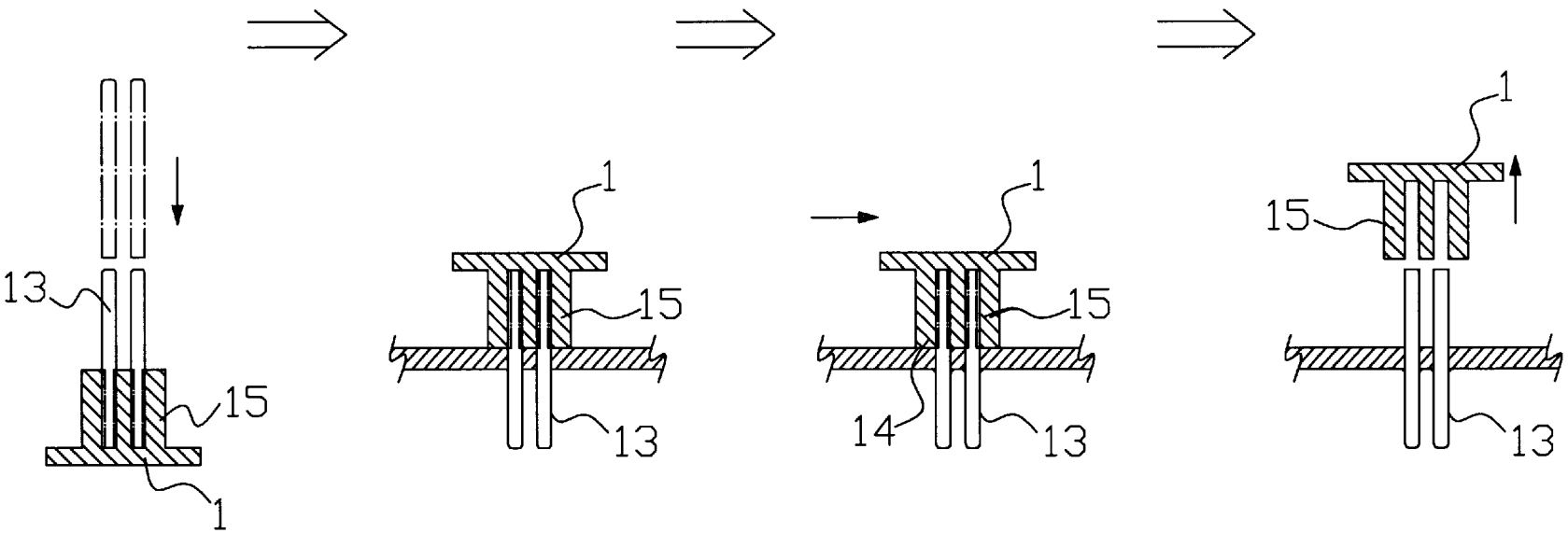
PRIOR ART FIG. 4
FIG. 4 is a schematic view showing the implementation of the conventional board-to-board connector of FIG. 3.
Figure 5:
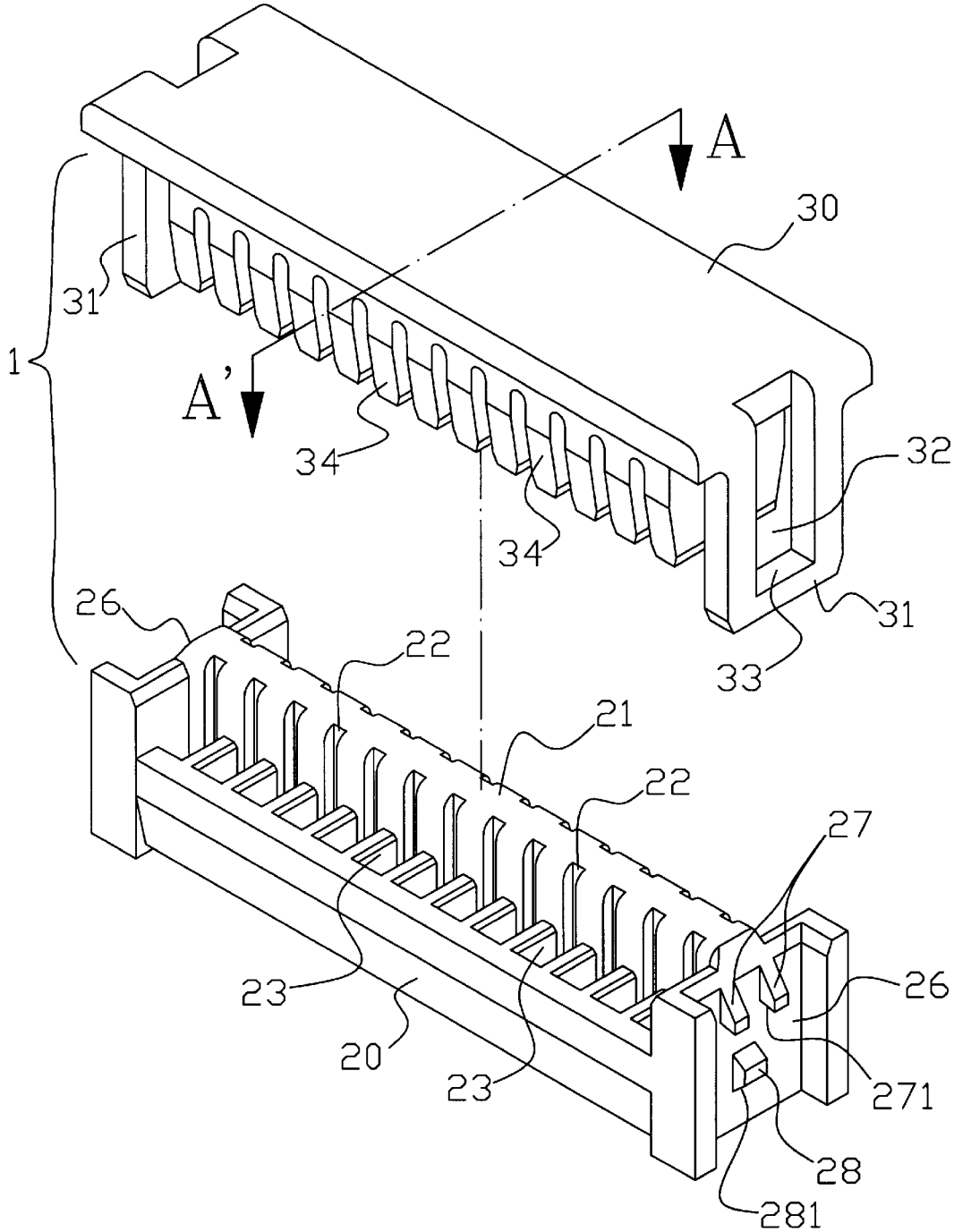
FIG. 5 is a perspective exploded view of the plastic housing of the present invention.

Referring to FIG. 5, there is shown the plastic housing 1 of the present invention essentially comprising a base seat 20 and a top cap 30.

Figure 6:
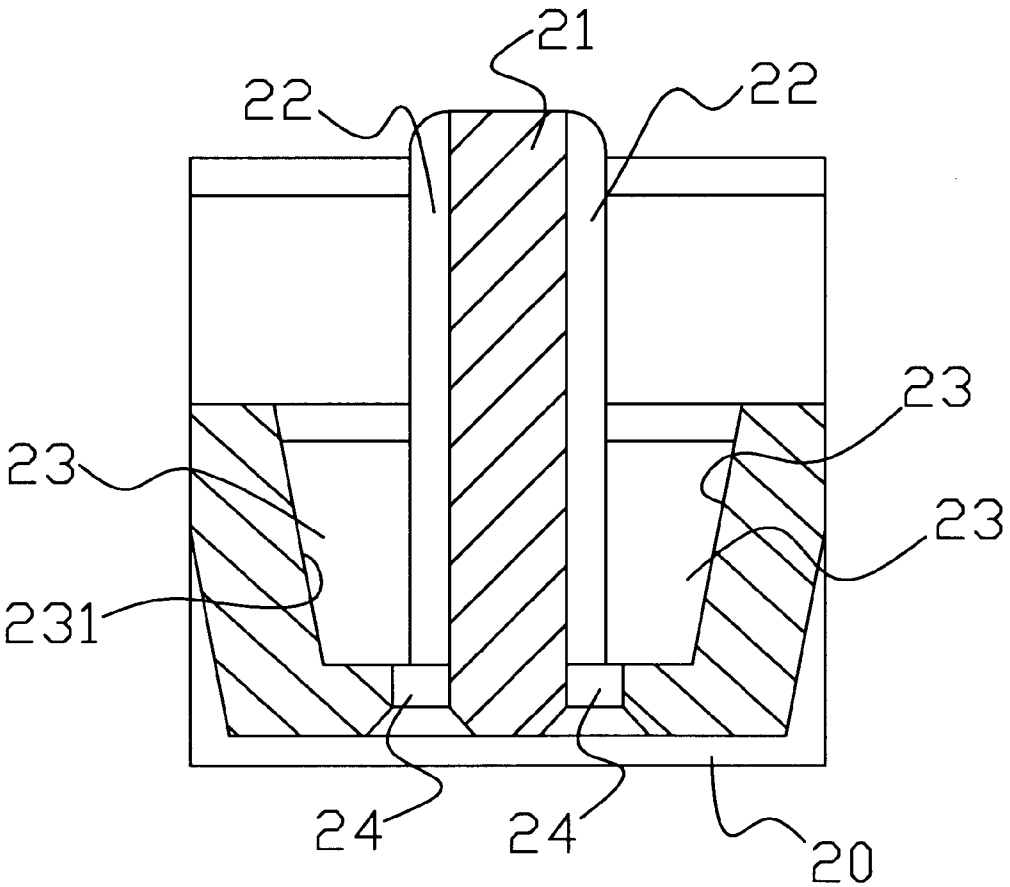
FIG. 6 is a sectional view of the structure of the base seat in accordance with the present invention.

As shown in FIGS. 5 and 6, the central surface of the base seat 20 is provided with a protruded rib portion 21, and a plurality of vertical slots 22 are provided to the left and right side of the rib 21. A plurality of notches 23 are located and correspond to the vertical slots 22. The inner wall of the notches 23 is provided with a sloping-shaped guiding surface 231. The bottom portion of the slot 22 is formed into a through hole 24 for the insertion of guiding pins 25. An engaging face 26 is provided to each of the ends of the rib portion 21, and a pair of blocking blocks 27 and a protrusion 28 are provided to the surface of the engaging face 26. The blocking blocks 27 are formed into a hole-like member and are provided with a sloping hook 271. The protrusion 28 is provided with sloping faces 281.

Figure 7:
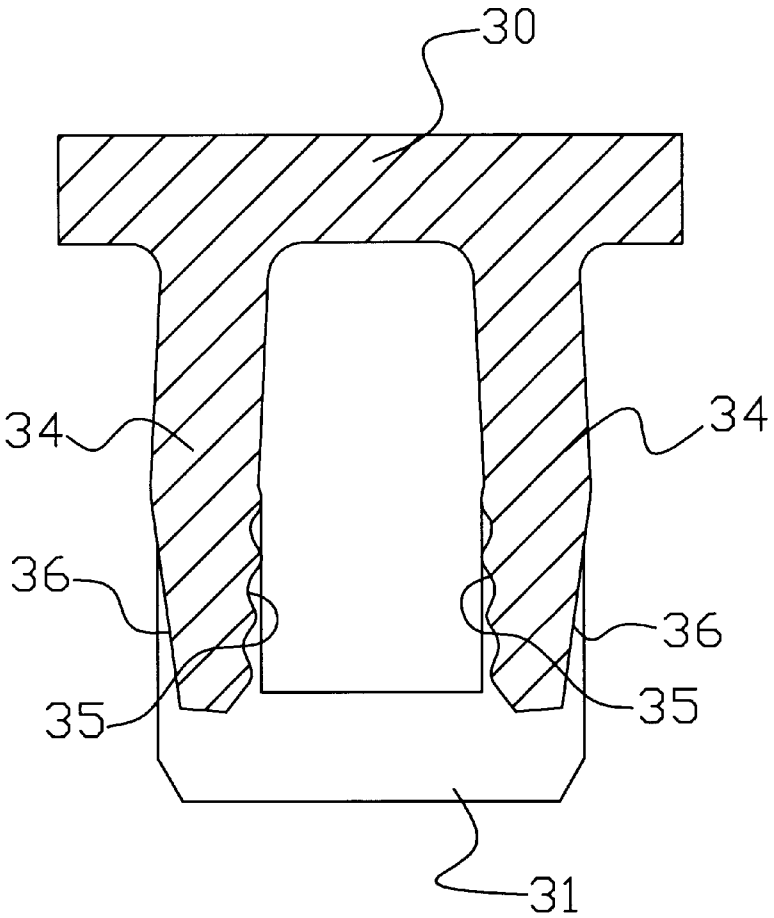
FIG. 7 is the sectional view along line A—A of the top cap of the present invention.

As shown in FIGS. 5 and 7, the top end of the top cap 30 is flat and the edge of the top cap 30 is provided with a center slot 32 having an engaging portion 31. The slot 32 is used to hold the blocking block 27 and the protrusion 28, and a sloping hook 33 is formed at the inner wall of the engaging portion 31 so that it can be engaged with the blocking block 27. The bottom surface of the top cap 30 is provided with a plurality of protruded blocks 34 having wavelike surface 35 at the inner surface thereof The outer side of the protruded block 34 is the engaging surface 36 for the engagement with the notch 23.

In accordance with the present invention, the gradient of the guiding surface 231 of the notch 23 is slightly larger than that of the engaging surface 36, and the engaging surface 36 is firmly engaged with the notch 23.

Figure 8:
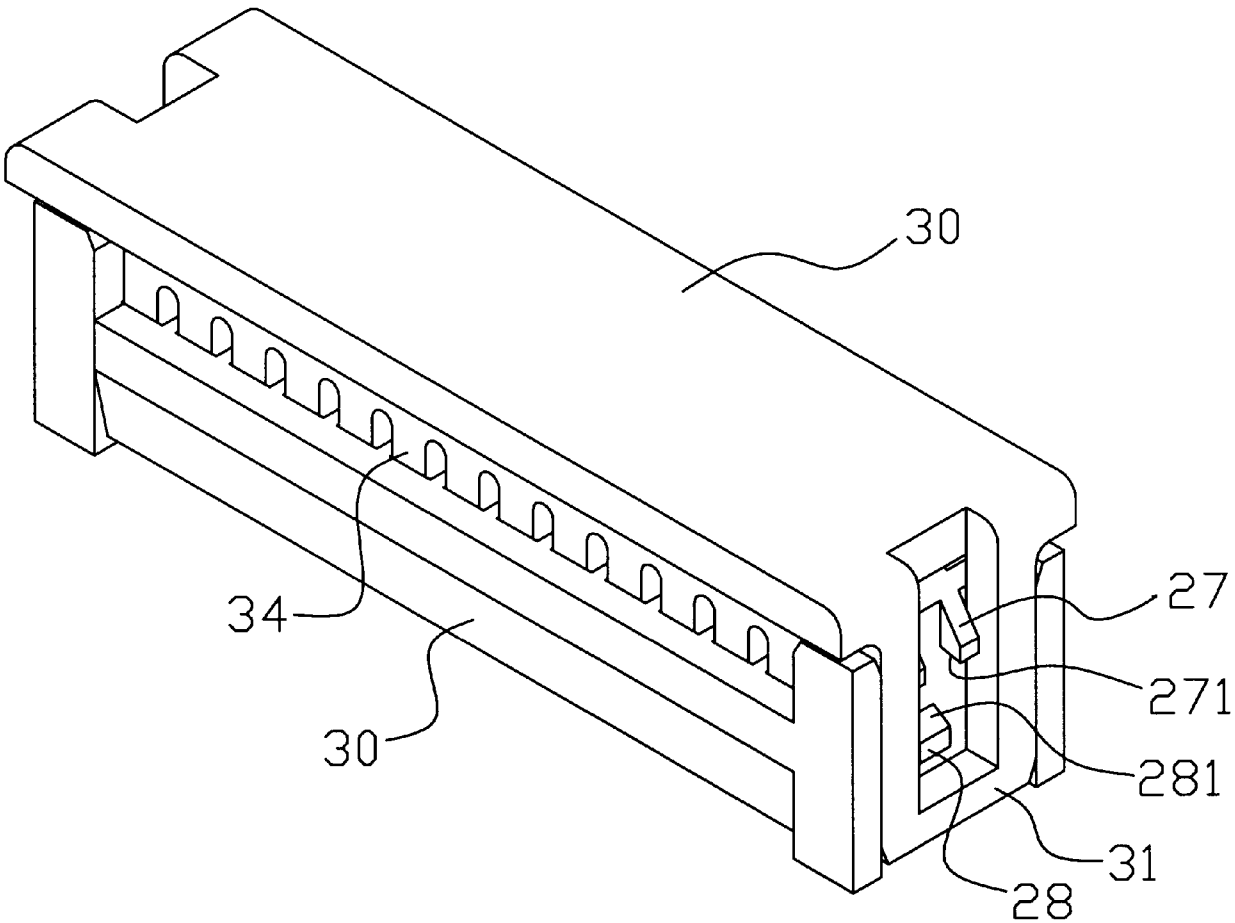
FIG. 8 is a perspective view of the plastic housing of the present invention.

As shown in FIG. 8, the base seat 20 is combined with the top cap 30 such that the protruded blocks 34 are in engagement with the notches 23 and the sloping hook 33 of the engaging portion 31 is hooked at the sloping face 281 of the protrusion 28, thereby a complete plastic housing 1 is obtained.

Figure 9:
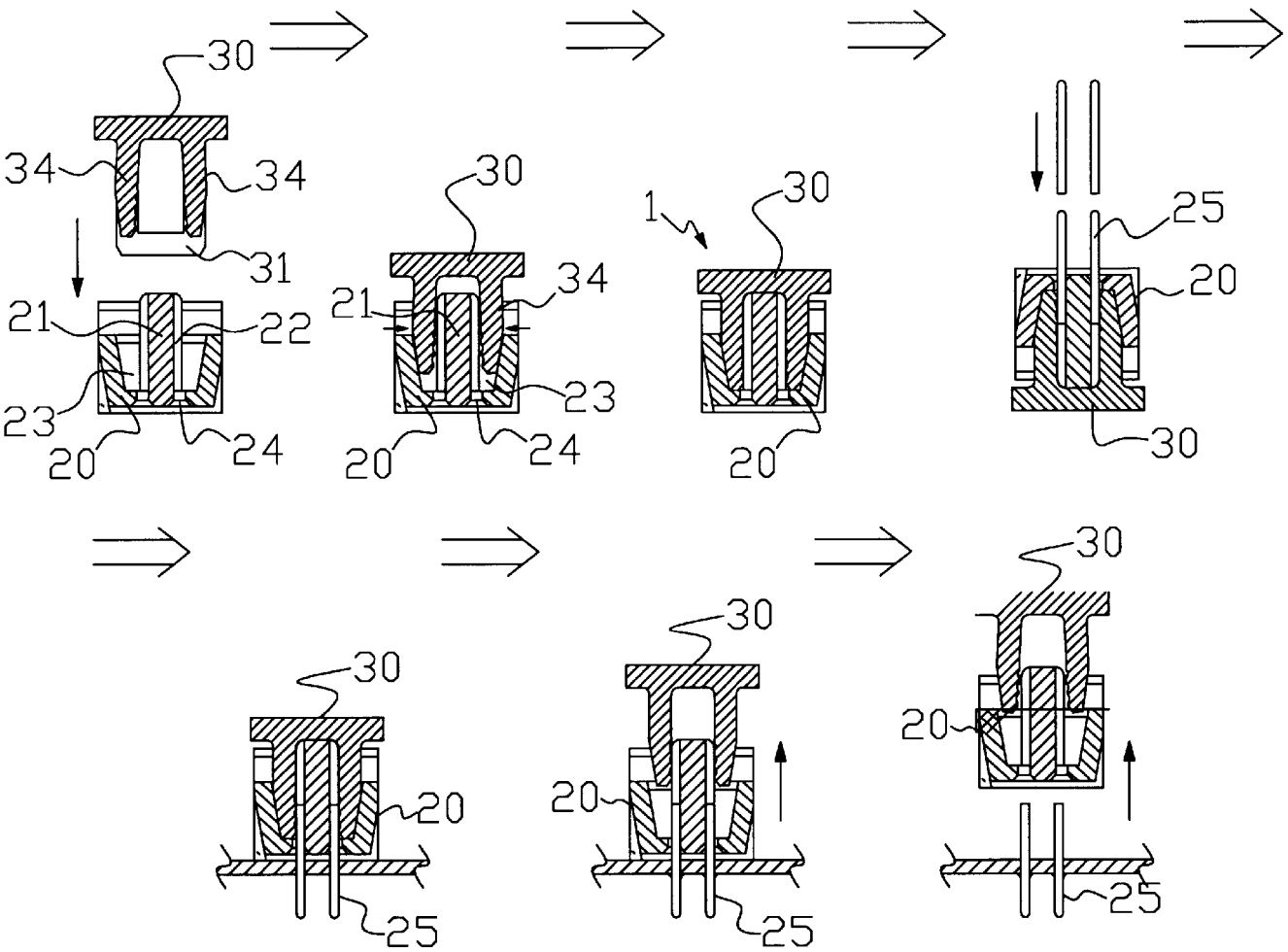
FIG. 9 shows the sectional view of a preferred embodiment of the present invention.

As shown in FIG. 9, the entire row of guiding pins 25 is mounted into the through hole 24 of the base seat 20. As the insertion of the through hole 24 is outwardly extended, this structure facilitates smooth insertion of the guiding pins 25. When the guiding pins 25 are inserted into the slots 22, due to the larger slope of the guiding surface 231, as compared to that of the engaging surface 36 of the protruded block 34, the protruded block 34 is urged closely to the rib portion 21, and the wavelike surface 35 provides a tight mounting. Thus, the guiding pins 25 will not dislocate during the process of soldering, and the guiding pins 25 are soldered together with the circuit. Finally, the top cap 30 is lifted, and due to the engaging surface 36 restores to its original state, it releases the tight urging of the guiding pins 25, and the base seat 20 is lifted altogether. Thus, the plastic housing 1 is removed and the guiding pins 25 remain on the circuit board.

Figure 10:
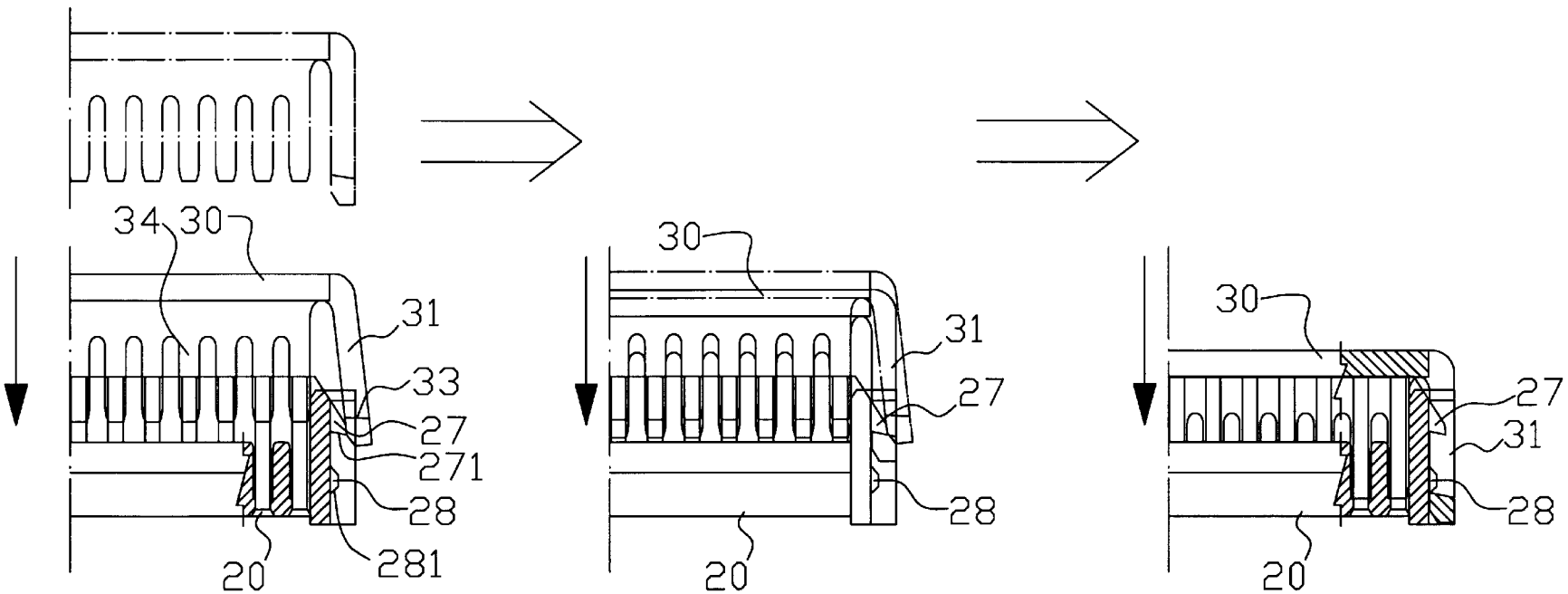
FIG. 10 is a schematic view showing the combination of the base seat and the top cap of the present invention.
Figure 11:
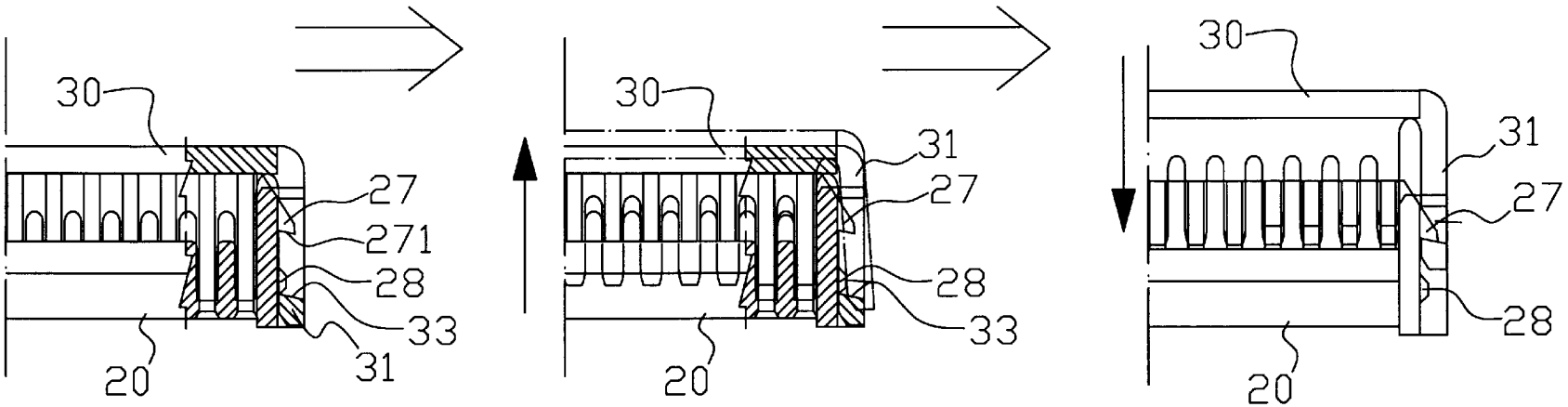
FIG. 11 is a schematic view showing the detachment of the top cap from the base seat of the present invention.

In accordance with the present invention, the base seat 20 and the top cap 30 can be rapidly mounted together, and when they are used on a connector, they are easily dislocated from the guiding pins 25. This is due to the engaging structure of the base seat 20 and the top cap 30. As shown in FIG. 10, in combination, the blocking block 27 at the sides of the base seat 20, and the sloping hook 33 for the engaging portion 31 provided by the protrusion 28 have a sloping hook 271 and a sloping surface 281. Thus, these structures can be easily mounted without applying much force. As shown in FIG. 11, when the top cap is to be lifted up, the engaging structure has a restriction effect. Due to the larger slope of the sloping surface 281 of the protrusion 28, the engaging portion 31 will not be affected and can be easily disengaged. But the upward action is restricted by the blocking block 27, and the sloping hook 271 of the blocking block 27 and the sloping hook 33 match with each other, an exact engagement is formed such that the base seat 20 is lifted up together with the top cap 30.

While this invention has been particularly shown and described with references to a preferred embodiment, it will be understood by those skilled in the art that various changes in form and details may be made therein without departing from the spirit and scope of the invention as defined by the appended claims.

I claim:

1. An improved structure of a plastic housing of a board-to-board connector for temporarily retaining guiding pins until the guiding pins are soldered to a circuit board, comprising a) a base seat having two longitudinal walls and a central protruded rib portion extending parallel to the two longitudinal walls with a plurality of slots along the two lateral sides of the rib portion, a through hole being formed at a bottom portion of each slot for receiving the guiding pin and an external side of the slots being corresponding to a plurality of notches formed on an inner surface of each of the two longitudinal walls, each notch having a sloping guiding surface at the inner surface thereof, at each longitudinal end of the rib portion, an engaging surface being provided, and a top surface of the engaging surface being provided with a blocking block and a protrusion; and b) a top cap having a flat top end, and two longitudinal ends of the cap each provided with an engaging portion, having a hollow recess for engagement with the blocking block and the protrusion of the engaging surface of the base seat, a bottom portion of the top cap having a plurality of corresponding protruded blocks extending in two parallel rows in a longitudinal direction, the two rows forming a center slot for receiving he central protruded rib portion of the base seat, the corresponding inner surface of the protruded blocks being wavelike surface to form into a sloping-shape engaging surface, so that protruded block is smoothly inserted and clipped at each notch, wherein the wavelike surface of the protruded block provides a tight mounting of the guiding pin to the sloping guiding surface of the notch, thereby the lifting of the top cap from the base seat causes the protruded blocks to release the clipping of the guiding pins, and the engagement of the engaging portion and the blocking block is partially released so that the base seat and the top cap will be lifted together, and thus the plastic housing is removed while the guiding pins are retained on the circuit board.

2. An improved structure of a plastic housing as set forth in claim 1, wherein the blocking block has a sloping hook.

3. An improved structure of a plastic housing as set forth in claim 1, wherein the hollow recess provides engagement for the blocking block and the protrusion, and the inner wall at the bottom section of the hollow recess is a sloping hook.

4. An improved structure of a plastic housing as set forth in claim 1, wherein the sloping of the guiding surface of the notch is slightly larger than that of the engaging surface of the protruded block.

* * * * *